United States Patent [19]

Krauss

[11] 4,386,450

[45] Jun. 7, 1983

[54] POSITIONING HINGE HAVING NARROW TERMINAL AREAS IN MATCHING CURVILINEAR SLOTS

[76] Inventor: Leonard Krauss, 4204 Melisa Ct., Carmichael, Calif. 95608

[21] Appl. No.: 289,248

[22] Filed: Aug. 3, 1981

[51] Int. Cl.[3] ..... E05D 15/06

[52] U.S. Cl. ..... 16/361; 16/363

[58] Field of Search ..... 16/348, 357, 360, 361, 16/362, 363; 312/138, 297, DIG. 33

[56] References Cited

U.S. PATENT DOCUMENTS 1,107,985 8/1914 Moskowitz ..... 312/297 X 1,128,620 2/1915 Münzner ..... 16/363 X 3,936,113 2/1976 Anderson ..... 312/297

*Primary Examiner*—Fred Silverberg

[57] ABSTRACT

A hinge for display panels and the like that holds a movable panel in any of two or more fixed positions about a horizontal axis. The hinge consists of a fixed bracket containing matching curvilinear slots which enclose tabs extending from a movable panel. Gravity and friction hold the movable panel in a storage position; from that position the panel is easily moved downward and forward simultaneously, to another predetermined position.

1 Claim, 4 Drawing Figures

POSITIONING HINGE HAVING NARROW TERMINAL AREAS IN MATCHING CURVILINEAR SLOTS

BACKGROUND OF THE INVENTION

1. Field of the Invention

This invention relates to a hinge, and more particularly to a hinge that establishes a movable segment in a predetermined position relative to a fixed bracket.

2. Disclosure Statement

Many types of hinges have been developed for general or specialized purposes, utilizing a variety of pivoting and retention arrangements. In an examination of prior art, none were found that employ the particular characteristics of this invention, particularly the use of flat tab-like extensions as pivots within curvilinear slots, and a simple and economical construction.

Heretofore hinge arrangements designed to position a movable panel in a predetermined relation to other components required relatively complex and costly mechanisms. This invention accomplishes the same purpose using fewer as well as less costly components, and permitting a more economical manufacture and assembly.

SUMMARY OF THE INVENTION

This invention relates to a hinge, and more particularly to a horizontal panel-positioning hinge which can be mounted on a fixed horizontal surface and position a movable panel, such as a display panel, in any of two or more predetermined positions, according to the shape of the fixed bracket's matching curvilinear slots.

One object, feature and advantage of the invention is the provision of a simple and economical hinge arrangement that will retain a movable panel in one of two or more predetermined positions.

Another object, feature and advantage of the invention is the provision of a hinge arrangement consisting of two basic parts, eliminating the necessity of a separate pivot pin.

Another object, feature and advantage of the invention is an arrangement that enables a panel to move in a crescent-shaped orbit rather than pivot about a fixed point, thereby avoiding a barrier that might block all or part of the front of the fixed bracket.

A further object, feature and advantage of the invention is the provision of a simple hinge arrangement that permits a movable panel to be held in a horizontal storage position beneath a surface such as a cabinet or shelf and from there to be easily swung to a downward, forward or intermediate position, as determined by the shape of the curvilinear slots.

These and other objects, features and advantages of the invention will become apparent upon consideration of the specifications and attached drawings forming part of this application and wherein like reference characters indicate like parts.

DETAILED DESCRIPTION OF THE INVENTION

Figure 1:
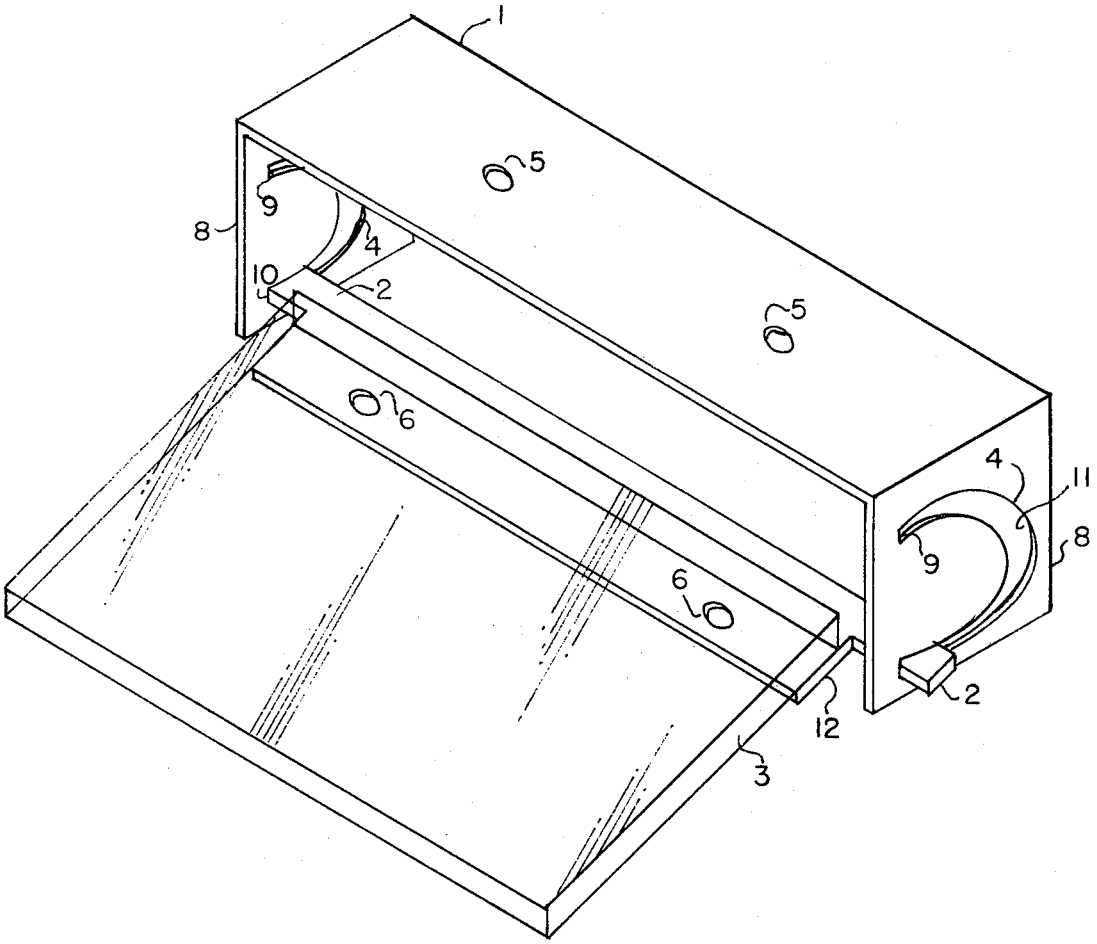
FIG. 1 is a perspective view of the invention, showing the fixed bracket, and with the movable panel in a downward and forward position.

Referring to the drawings, and in particular to FIG. 1, there is shown the fixed or stationary bracket 1 with two holes 5 as one means for attachment to the underside of a cabinet or other fixed object. This bracket has two end pieces 8 containing matching curvilinear slots 4 into which the tabs or flat extensions 2 of the movable panel 3 fit. The flat extensions 2 are an integral part of the movable bracket 12 which is attached to movable panel 3 by the use of holes 6 for bolts, rivets or similar devices, by bonding or by other common means. The movable panel 3 is shown in the lower position with the flat extensions 2 serving as bearing surfaces, located at the end 10 of the slot 4. The sides of slot 4 prevent the flat extensions 2 from pivoting, thus holding the movable panel 3 in the desired position.

Figure 2:
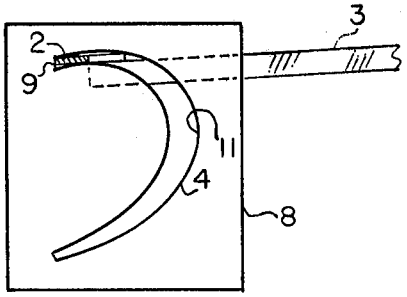
FIG. 2 is an end view that shows the curved slot, and with the movable panel held therein in a horizontal storage position.
Figure 3:
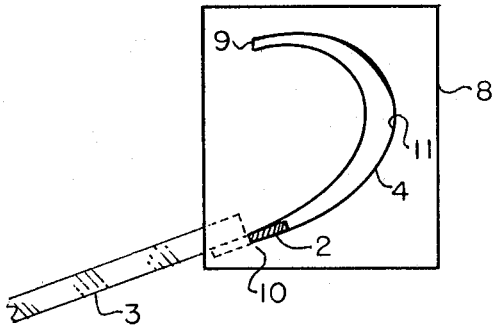
FIG. 3 is an end view showing the movable panel relocated from the position of FIG. 2 and resting in a downward and forward position.

FIG. 2 shows end 8 of the stationary bracket, with the flat extension 2 at the terminal area 9 at the end of slot 4. Since slot 4 is only slightly wider than the thickness of extension 2, movable panel 3 rests there in an essentially horizontal position, held there by gravity and friction. Rearward pressure on panel 3 will move it away from the end of the slot and, with the added effect of gravity, will cause the flat extension 2 to move in a curvilinear direction matching the curve of slot 4. The maximum width of slot 4, as shown at point 11, is less than the width of flat extension 2, thus limiting pivotal motion and requiring it to follow the curve to the end 10 of slot 4, as shown in FIG. 3.

Pressure applied in an upward and rearward direction to the lower end of movable panel 3 will cause the upper end to move in a curvilinear direction determined by the shape of slot 4 until it reaches end 9, whereupon it will rest in the position shown in FIG. 2.

Figure 4:
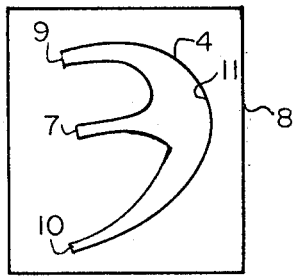
FIG. 4 is an end view of the fixed bracket, illustrating an alternate version that has the curvilinear slots constructed so as to provide one additional terminal area or resting position for the movable panel.

If additional terminal positions are desired for movable panel 3, the shape of slot 4 can be modified as illustrated in FIG. 4, with the slot end 7 functioning in the same manner as end 10.

Thus this invention provides a new and novel hinge arrangement which is useful for various purposes and devices, including uses such as in display units, bookholders or store shelf panels.

While the above description illustrates specific aspects of the invention, they do not limit the scope of the invention or its utilization, but rather constitute preferred embodiments. Many variations other than those illustrated are possible and are included in the appended claims.

What is claimed as new is as follows:

1. A hinge arrangement comprising: a stationary bracket adapted to be horizontally mounted by attachment means to a fixed object or surface, said bracket having two opposed end pieces, said end pieces having matching curvilinear slots, a movable bracket attached to the stationary bracket by means of extensions, said extensions having only flat surfaces, the flat extensions are contained within the matching curvilinear slots, said slots comprising opposite support surfaces, said extensions contacting the support surfaces at points of bearing, during the movement of the movable bracket along the slots the points of bearing migrate along the support surfaces, each of the matching curvilinear slots having an opening sufficiently wide to accommodate movement of the flat extensions of the movable bracket along the curve of the slots, said opening being less than the width of the flat extensions, thus pivotal movement of the movable bracket is limited as the movable bracket migrates along the curve of the slots, said slots containing at least two substantially horizontal terminal areas, wherein at the terminal areas portions of the slots are narrowed to a width slightly greater than the thickness of the flat extensions, the weight of the movable bracket when the movable bracket is located at the terminal areas causes the flat extensions to pivot slightly and become wedged in the terminal areas to maintain the movable bracket in at least two predetermined oppositely facing substantially horizontal positions relative to the stationary bracket.

* * * * *